US007243733B2

(12) United States Patent
McGuire et al.

(10) Patent No.: US 7,243,733 B2
(45) Date of Patent: Jul. 17, 2007

(54) CUP TOOL FOR A HIGH-PRESSURE MANDREL AND METHOD OF USING SAME

(75) Inventors: Bob McGuire, Oklahoma City, OK (US); Danny Lee Artherholt, Asher, OK (US)

(73) Assignee: Stinger Wellhead Protection, Inc., Allen, TX (US)

( * ) Notice: Subject to any disclaimer, the term of this patent is extended or adjusted under 35 U.S.C. 154(b) by 0 days.

(21) Appl. No.: 11/182,873

(22) Filed: Jul. 15, 2005

(65) Prior Publication Data

US 2007/0012439 A1 Jan. 18, 2007

(51) Int. Cl.
*E21B 33/126* (2006.01)

(52) U.S. Cl. ..... 166/387; 166/202

(58) Field of Classification Search ..... 166/387, 166/202; 285/110, 332, 350
See application file for complete search history.

(56) References Cited

U.S. PATENT DOCUMENTS

| | | | | | |
|---|---|---|---|---|---|
| 2,664,952 | A | * | 1/1954 | Losey | 277/335 |
| 2,723,721 | A | * | 11/1955 | Corsette | 277/341 |
| 2,767,795 | A | * | 10/1956 | Bush | 277/335 |
| 2,927,643 | A | | 3/1960 | Dellinger | 166/75 |
| 2,992,841 | A | * | 7/1961 | Steinberger | 166/202 |
| 3,100,015 | A | | 8/1963 | Regan | 166/46 |
| 3,177,942 | A | | 4/1965 | Haeber | 166/66.5 |
| 4,023,814 | A | | 5/1977 | Pitts | 277/328 |
| 4,111,261 | A | | 9/1978 | Oliver | 166/90.1 |
| 4,152,924 | A | | 5/1979 | Mayo | 73/40.5 |
| 4,241,786 | A | | 12/1980 | Bullen | 166/77.4 |
| 4,315,543 | A | * | 2/1982 | Luers et al. | 166/202 |
| 4,601,494 | A | | 7/1986 | McLeod | 285/110 |
| 4,632,183 | A | | 12/1986 | McLeod | 166/77 |
| 4,657,075 | A | | 4/1987 | McLeod | 166/72 |
| 4,867,243 | A | | 9/1989 | Garner et al. | 166/379 |
| 4,961,465 | A | * | 10/1990 | Brandell | 166/184 |
| 5,012,865 | A | | 5/1991 | McLeod | 166/90 |
| 5,020,592 | A | | 6/1991 | Muller et al. | 166/187 |
| 5,060,723 | A | | 10/1991 | Sutherland et al. | 166/202 |
| 5,103,900 | A | | 4/1992 | McLeod et al. | 166/88 |
| 5,261,487 | A | | 11/1993 | McLeod et al. | 166/85.3 |
| 5,396,956 | A | | 3/1995 | Cherewyk et al. | 166/250 |
| 5,975,211 | A | | 11/1999 | Harris | 166/379 |
| 6,145,596 | A | | 11/2000 | Dallas | 166/379 |
| 6,220,363 | B1 | | 4/2001 | Dallas | 166/382 |
| 6,247,537 | B1 | | 6/2001 | Dallas | 166/379 |
| 6,289,993 | B1 | | 9/2001 | Dallas | 166/386 |
| 6,557,629 | B2 | | 5/2003 | Wong et al. | 166/76.1 |

(Continued)

FOREIGN PATENT DOCUMENTS

| | | | |
|---|---|---|---|
| CA | 1272684 | 8/1990 | 166/59 |
| EP | 0372594 | 10/1989 | |

*Primary Examiner*—David Bagnell
*Assistant Examiner*—Daniel P Stephenson
(74) *Attorney, Agent, or Firm*—Nelson Mullins Riley & Scarborough, LLP

(57) ABSTRACT

A cup tool includes a cup tool tube having a threaded upper end for connection to a high-pressure mandrel. The cup tool has an outer surface over which an elastomeric cup is slidably mounted for movement from an unset position for entry into a wellbore to a set position in which an annular gap is obstructed to contain fluid pressure below the elastomeric cup. The cup tool tube includes an annular jump step designed to inhibit movement of the cup to the set position during insertion of the cup tool into the wellbore, and a gauge ring located above the jump step.

20 Claims, 4 Drawing Sheets

U.S. PATENT DOCUMENTS

| | | | | |
|---|---|---|---|---|
| 6,626,245 | B1 | 9/2003 | Dallas | 166/379 |
| 6,666,266 | B2 | 12/2003 | Starr et al. | 166/90.1 |
| 6,769,489 | B2 | 8/2004 | Dallas | 166/386 |
| 6,817,421 | B2 | 11/2004 | Dallas | 166/379 |
| 2002/0174988 | A1 | 11/2002 | Szarka | 166/325 |
| 2004/0007366 | A1* | 1/2004 | McKee et al. | 166/387 |
| 2004/0055742 | A1 | 3/2004 | Dallas | 166/85.3 |
| 2005/0082066 | A1 | 4/2005 | McGuire et al. | 166/379 |
| 2005/0199389 | A1 | 9/2005 | Dallas et al. | 166/250.07 |
| 2006/0090904 | A1 | 5/2006 | McGuire et al. | 166/387 |
| 2006/0151182 | A1 | 7/2006 | Slack | 166/387 |

* cited by examiner

CUP TOOL FOR A HIGH-PRESSURE MANDREL AND METHOD OF USING SAME

CROSS-REFERENCE TO RELATED APPLICATIONS

This is the first application filed for the present invention.

MICROFICHE APPENDIX

Not applicable.

FIELD OF THE INVENTION

This invention generally relates to wellhead isolation equipment and, in particular, to a cup tool for a high-pressure mandrel used for isolating a wellhead.

BACKGROUND OF THE INVENTION

Most oil and gas wells require stimulation to enhance hydrocarbon flow to make or keep them economically viable. The servicing of oil and gas wells to stimulate production requires the pumping of fluids into the well under high pressure. The fluids are generally corrosive and/or abrasive because they are laden with corrosive acids and/or abrasive proppants, such as sharp sand or sintered bauxite.

In order to protect components that make up the wellhead, such as the valves, tubing hanger, casing hanger, casing head and blowout preventer equipment, wellhead isolation equipment, such as a wellhead isolation tool, a casing saver or a blowout preventer protector is used during well fracturing and well stimulation procedures. The wellhead isolation equipment generally includes a high-pressure mandrel that is inserted through wellhead components to isolate the wellhead components from elevated fluid pressures and from the corrosive/abrasive fluids used in the well treatment to stimulate production. A sealing mechanism, generally referred to as a sealing nipple or a cup tool, connected to a bottom of the high pressure mandrel is used to isolate the wellhead components from high fluid pressures used for well stimulation treatments.

Various sealing mechanisms provided for wellhead isolation equipment are described in prior art patents, such as U.S. Pat. No. 4,023,814, entitled A TREE SAVER PACKER CUP, which issued to Pitts on May 17, 1977; U.S. Pat. No. 4,111,261, entitled A WELLHEAD ISOLATION TOOL, which issued to Oliver on Sep. 5, 1978; U.S. Pat. No. 4,601,494, entitled A NIPPLE INSERT, which issued to McLeod et al. on Jul. 22, 1986; Canadian Patent 1,272,684, entitled A WELLHEAD ISOLATION TOOL NIPPLE, which issued to Sutherland-Wenger on Aug. 14, 1990; U.S. Pat. No. 5,261,487 entitled PACKOFF NIPPLE, which issued to McLeod et al. on Nov. 16, 1993; and Applicant's U.S. Pat. No. 6,918,441 entitled CUP TOOL FOR HIGH PRESSURE MANDREL, which issued Jul. 19, 2005. These sealing mechanisms include an elastomeric cup that radially expands under high fluid pressures to seal against an inside wall of a production tubing or casing.

Elastomeric cups are commonly bonded to a steel ring, sleeve or mandrel. In the most common construction, the elastomeric cup is bonded to a steel ring that slides over a cup tool tube, also referred to as a cup tool mandrel. An O-ring seal carried by the steel ring provides a fluid seal between the elastomeric cup and the cup tool tube.

A cup tool having a unitary elastomeric cup was disclosed in Applicants'co-pending U.S. patent application published on May 4, 2006 under Publication No. 2006-0090904 A1 (McGuire et al.) entitled CUP TOOL, CUP TOOL CUP AND METHOD OF USING THE CUP TOOL which was filed Nov. 2, 2004, the specification of which is incorporated herein by reference.

As shown in FIG. 1, an exemplary embodiment of Applicants' above-referenced prior-art cup tool, designated generally by reference numeral 10, includes a cup tool tube 12, also known as a cup tool mandrel. The cup tool tube 12 includes upper threads 14 for connecting to a high-pressure mandrel (not shown) and bottom threads 16 for connecting to a bullnose 18. The cup tool tube 12 includes an upper annular shoulder 20 disposed beneath the upper threads 14. A gauge ring 22 is retained between a bottom surface of the upper annular shoulder 20 and a top surface of a unitary elastomeric cup 24. The cup can be actuated to provide a high-pressure fluid seal between the cup tool and a surrounding casing or tubing 25. The cup 24 includes a downwardly depending skirt 26 defining an annular cavity 28 between the skirt 26 and the cup tool tube 12. The cup 24 also includes a lip seal 30 that protrudes downwardly and radially inwardly. The lip seal 30 rides against an inner surface of the cup tool tube. The lip seal seals against a tapered region 32 of the cup tool tube 12 when the cup 24 is forced upwardly by fluid pressure to a set position. Pressurization of the annular cavity 28 within the skirt 26 causes the skirt 26 to expand outwardly against the inner surface of the casing or tubing 25 and actuates the cup 24 into the set or sealing position by extruding the upper end of the cup 24 over the gauge ring 22 and into an annular gap 34 between the gauge ring 22 and the casing or tubing 25.

SUMMARY OF THE INVENTION

It is an object of the invention to provide an improved cup tool that is simple and inexpensive to manufacture and also provides a reliable seal at very high fluid pressures to protect pressure-sensitive wellhead components from the deleterious effects of high-pressure fracturing and stimulation operations.

The invention therefore provides a cup tool for providing a high-pressure fluid-tight seal in an annular gap between a high-pressure mandrel and a tubing or a casing in a wellbore. The cup tool comprises a cup tool tube having a threaded upper end for connection to the high-pressure mandrel, the cup tool tube having an outer surface over which an elastomeric cup is slidably mounted for movement from an unset position for entry of the cup tool into the wellbore to a set position in which the annular gap is obstructed to contain fluid pressure below the elastomeric cup, the cup tool tube including an annular jump step located below the threaded upper end, the annular jump step having a flat lower face and an outer diameter large enough to inhibit movement of the elastomeric cup to the set position during insertion of the cup tool into the wellbore; and a gauge ring located between the annular jump step and the high pressure mandrel, the gauge ring having a larger diameter than the annular jump step to restrict the annular gap.

The invention further provides a method of stimulating a well by injecting high pressure fluid through one of a casing and a tubing string suspended in a wellbore of the well. The method comprises installing a cup tool on a bottom end of the high-pressure mandrel, the cup tool comprising a cup tool tube having an outer surface over which an elastomeric cup is slidably mounted for movement from an unset position for entry of the cup tool into the wellbore to a set position in which fluid pressure is contained below the elastomeric cup, the cup tool tube including an annular jump step, the annular jump step having an outer diameter large enough to inhibit movement of the elastomeric cup to the set position during insertion of the cup tool into the wellbore, and a gauge ring located between the annular jump step and the high pressure mandrel, the gauge ring having a diameter larger than the annular jump step; and, injecting high pressure fluid through the high pressure mandrel and into the wellbore to move the elastomeric cup to the set position in which the elastomeric cup jumps over the annular jump step and extrudes upwardly into an annular gap between the gauge ring and the one of the casing and the tubing string to provide a high-pressure fluid-tight seal to protect wellhead components from the high pressure fluid injected to stimulate the well.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

In general, as will be explained below, the invention provides a cup tool for providing a high-pressure fluid-tight seal in an annular gap between a high-pressure mandrel and a casing or a production tubing in a wellbore. The cup tool includes a cup tool tube having a threaded upper end for connection to the high-pressure mandrel and an elastomeric cup that is slidably received on an outer surface of the cup tool tube. When the cup is exposed to elevated fluid pressures, a top end of the elastomeric cup is forced up over an annular step (jump step) into abutment with a gauge ring, which causes the cup to move into a set position in which the cup extrudes into the annular gap to provide the high-pressure fluid seal. A bullnose, or the like, is threaded to a bottom of the cup tool tube to protect the cup while guiding the cup tool through a wellhead. The annular jump step inhibits premature setting of the elastomeric cup during insertion of the cup tool through restrictions in the wellhead or tubing string.

Figure 1:
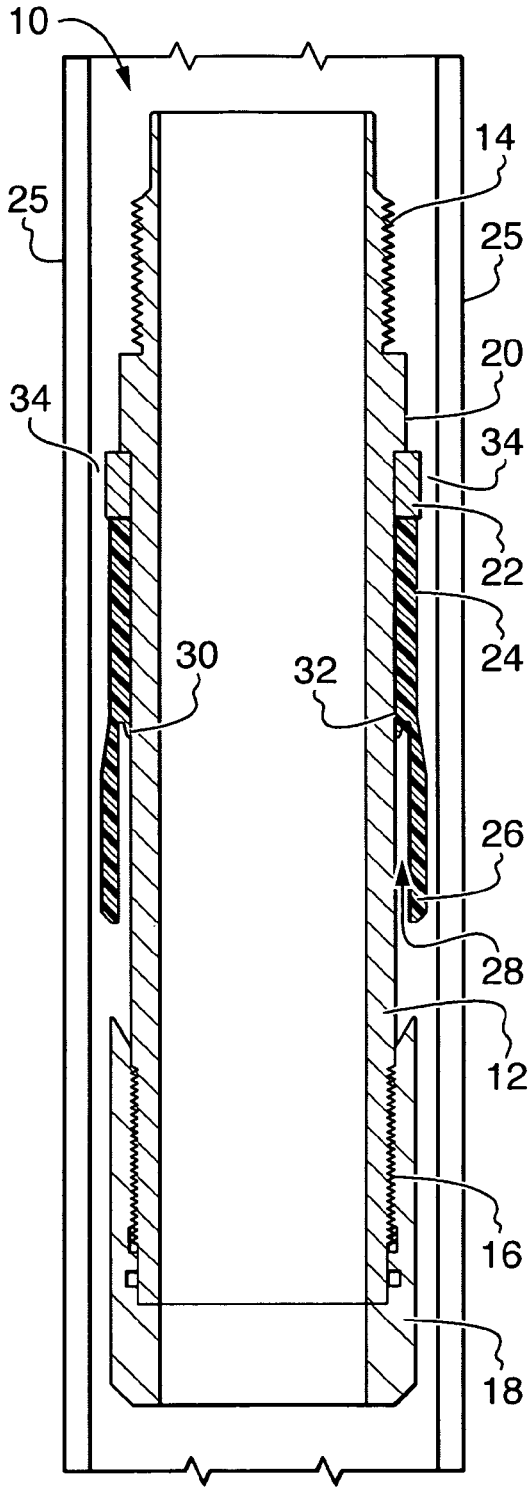
FIG. 1 PRIOR ART
FIG. 1 is a cross-sectional view of a prior-art cup tool for a high-pressure mandrel.
Figure 2:
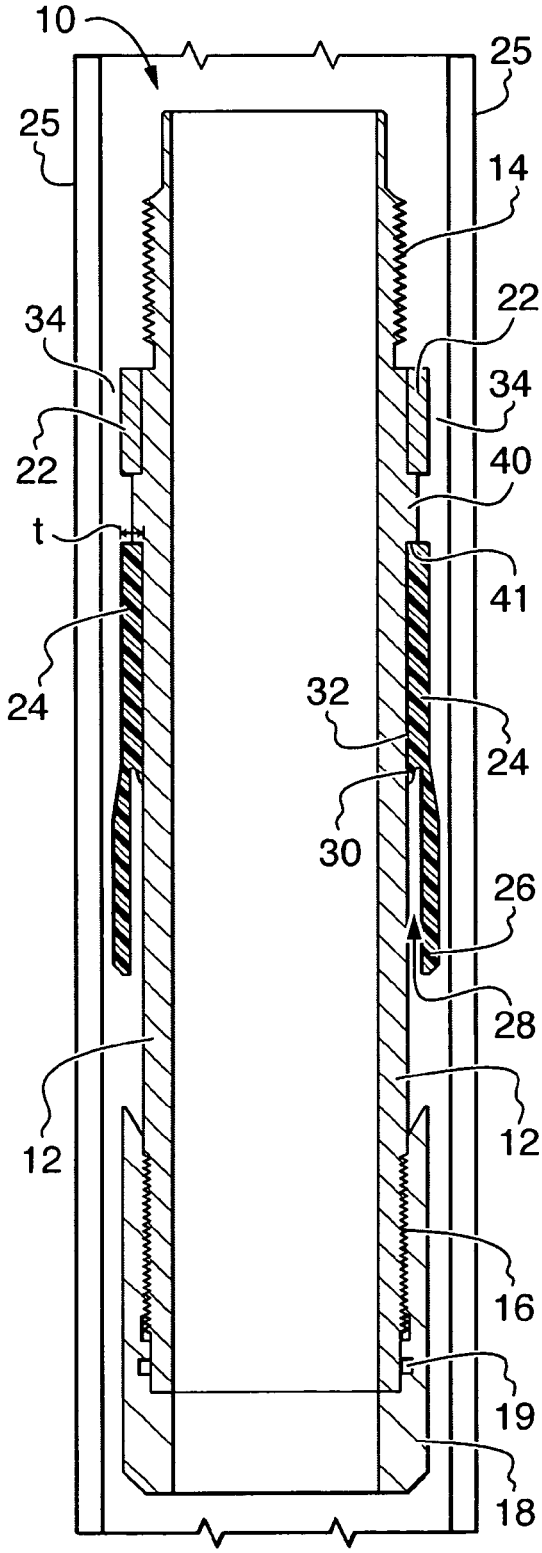
FIG. 2 is a cross-sectional view of a cup tool for a high-pressure mandrel in accordance with an embodiment of the invention wherein a gauge ring is slipped onto the cup tool.

FIG. 2 illustrates a cup tool 10 in accordance with one embodiment of the invention. The cup tool 10 includes a cup tool tube 12. The cup tool tube 12 has a set of upper pin threads 14 for connection to a high-pressure mandrel (not shown in this figure). The cup tool tube also includes a set of lower pin threads 16 for connection to a bullnose 18. In one embodiment, the bullnose 18 has an annular groove 19 that receives an annular sealing element such as an O-ring or ring gasket for providing a fluid-tight seal between the bullnose 18 and the cup tool tube 12.

As shown in FIG. 2, the cup tool 10 includes an elastomeric cup 24 that is slidably mounted over an outer surface of the cup tool tube as described in Applicant's U.S. Pat. 6,918,441 referenced above.

As also shown in FIG. 2, the cup tool 10 includes a gauge ring 22 which, in this embodiment, slides onto the cup tool tube prior to threading the high-pressure mandrel onto the upper pin threads 14. The gauge ring can be machined from steel to provide a right-angled step that inhibits the elastomeric cup from moving to the set position as it is stroked into the wellbore, while permitting extrusion of the elastomeric cup into the annular gap 34 when the elastomeric cup is exposed to high fluid pressures.

The gauge ring 22 is secured between the bottom of the high-pressure mandrel (not shown) and a top surface of the annular jump step 40. The annular jump step 40 protrudes radially outwardly from the cup tool tube so as to vertically (or axially) separate the gauge ring 22 from the cup 24. In other words, the elastomeric cup abuts the bottom surface of the annular jump step 40 in the unset position while the gauge ring rests against the top surface of the annular jump step 40. The annular jump step 40 is integral with the cup tool tube and can be readily formed by turning the cup tool tube on a lathe in a manner well known in the art.

As shown in FIG. 2, the annular jump step 40 has flat bottom face 41 and an outer diameter ($OD_{STEP}$) that is designed to inhibit premature upward movement of the cup when the cup tool is inserted through restrictions in the wellbore. However, the annular jump step is designed to permit the cup to move into the set position after pressurized fluid is injected through the cup tool 10.

In the embodiment shown in FIG. 2, the outer diameter of the annular jump step 40 is expressed by the formula:

$$OD_{STEP}=ID_{TUBING}-2t+IFT \text{ where:}$$

$ID_{TUBLNG}$ represents the inner diameter of the casing or tubing 25;

t represents the wall thickness of the upper portion of the cup; and

IFT represents an interference fit tolerance for providing a high-pressure fluid-tight seal between the elastomeric cup 24 and the casing or tubing 25. For typical elastomeric cups, the interference fit tolerance is about 0.100" to 0.140".

For example, a 2.5" cup tool 10 with a polyurethane cup of 80–100 Durometer would require an interference fit tolerance of about 0.120". This amount of interference between the wall of the cup 24 (when the cup has jumped over the annular jump step 40) and the casing or tubing 25 enables the cup 24 to extrude under typically encountered injection pressures into the annular gap 34 to provide a reliable high-pressure seal between the gauge ring 22 and the casing or tubing 25.

In the embodiment shown in FIG. 2, the diameter of the annular jump step 40 is approximately equal to:

$$(OD_{CUP}+ID_{CUP})/2$$

where, $OD_{CUP}$ represents the outer diameter of the upper end of the cup 24 in the unset condition; and For certain operations, it may be desirable to install two cup tools 300 in a double cup tool configuration. In a double cup tool configuration, two cup tools are connected end-to-end, with a suitable adapter in between. The lower cup tool typically has a bullnose and acts as the primary seal while the upper cup tool connects to the high-pressure mandrel and acts as a backup seal to prevent fluid leakage if the primary seal fails. A double cup tool is disclosed in Applicant's above-referenced U.S. Pat. No. 6,918,441 entitled CUP TOOL FOR HIGH PRESSURE MANDREL.

In operation, the elastomeric cup 24 will only "jump" over the annular jump step 40 to move from the unset to the set position when the injection pressure reaches a predetermined threshold. When the cup 24 jumps over the annular jump step 40, the cup will move upward to abut the underside of the gauge ring 22. Further elevation of the injection pressure will cause the cup 22 to extrude into the annular gap 34 to form a high-pressure seal between the gauge ring 22 and the casing or tubing 25, thus isolating the pressure-sensitive wellhead components from the effects of high-pressure fracturing and stimulation fluids in the well. As is understood by those skilled in the art, the size of the annular gap 34 is controlled to limit extrusion of the elastomeric cup through the annular gap 34. This control over the size of the annular gap 34 is exercised by selecting a gauge ring 22 to match a diameter and a weight of the tubing or casing into which the cup tool 10 is being run. The selection of an appropriately dimensioned gauge ring is a process well understood by persons skilled in the art.

Five other embodiments of the invention are shown in FIGS. 3–7. Most of the components of these other embodiments are identical to those described above and thus are not redundantly described below.

Figure 3:
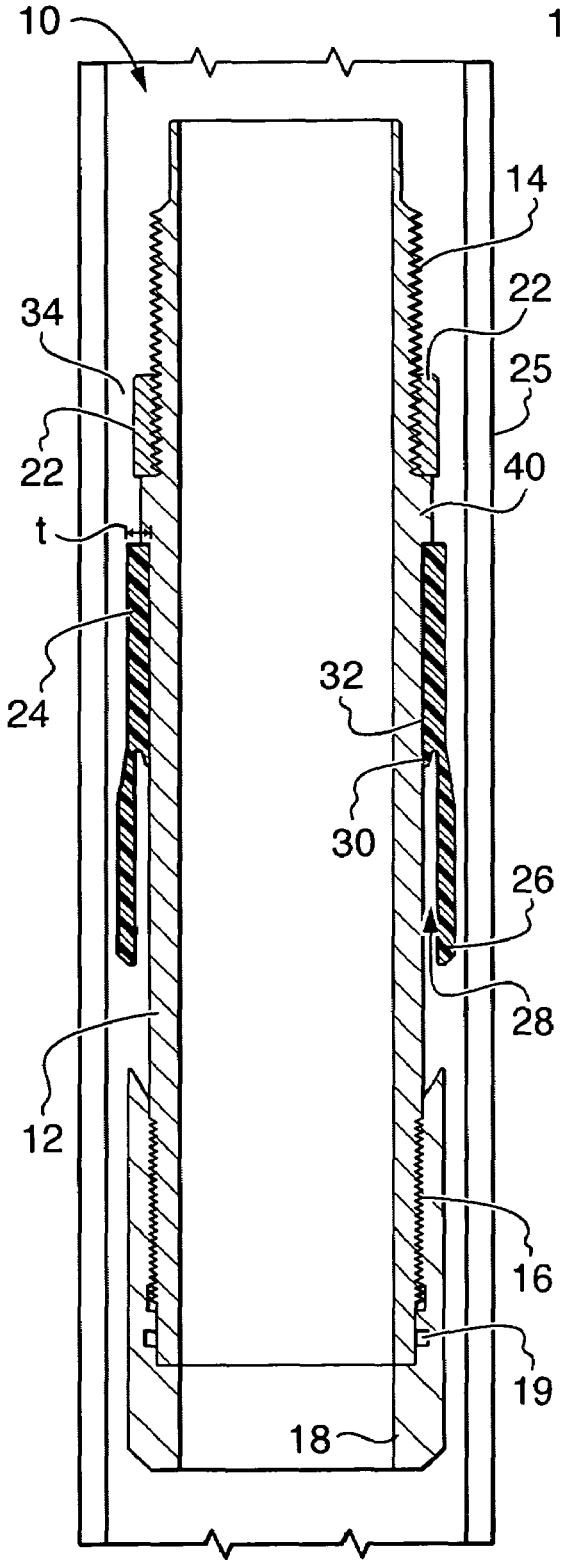
FIG. 3 is a cross-sectional view of a cup tool for a high-pressure mandrel in accordance with another embodiment of the invention wherein a gauge ring is threaded onto the cup tool.

As illustrated in FIG. 3, in another embodiment of the invention, the gauge ring 22 is threaded onto the upper pin threads 14 of the cup tool tube 12. The high-pressure mandrel is then connected to the same upper pin threads 14, thus locking the gauge ring between the high-pressure mandrel and the annular jump step 40.

Figure 4:
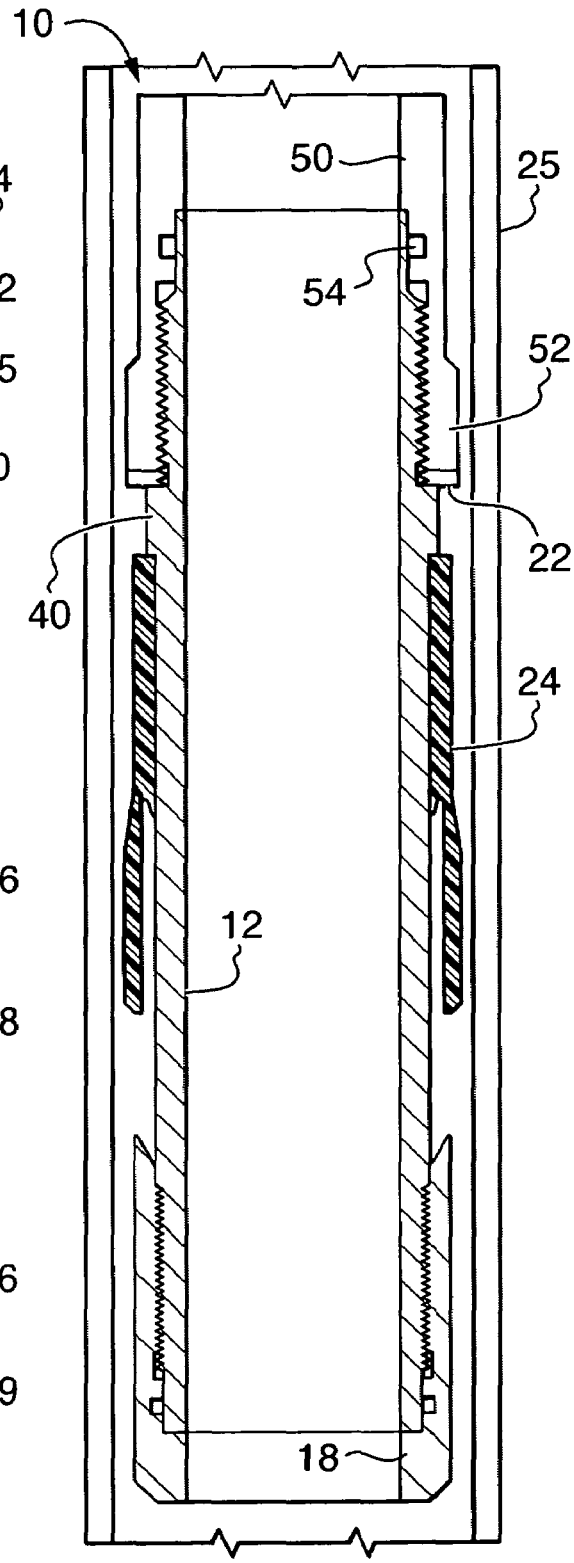
FIG. 4 is a cross-sectional view of a cup tool for a high-pressure mandrel in accordance with another embodiment of the invention wherein the gauge ring is integrally formed with a bottom end of the high-pressure mandrel.
Figure 5:
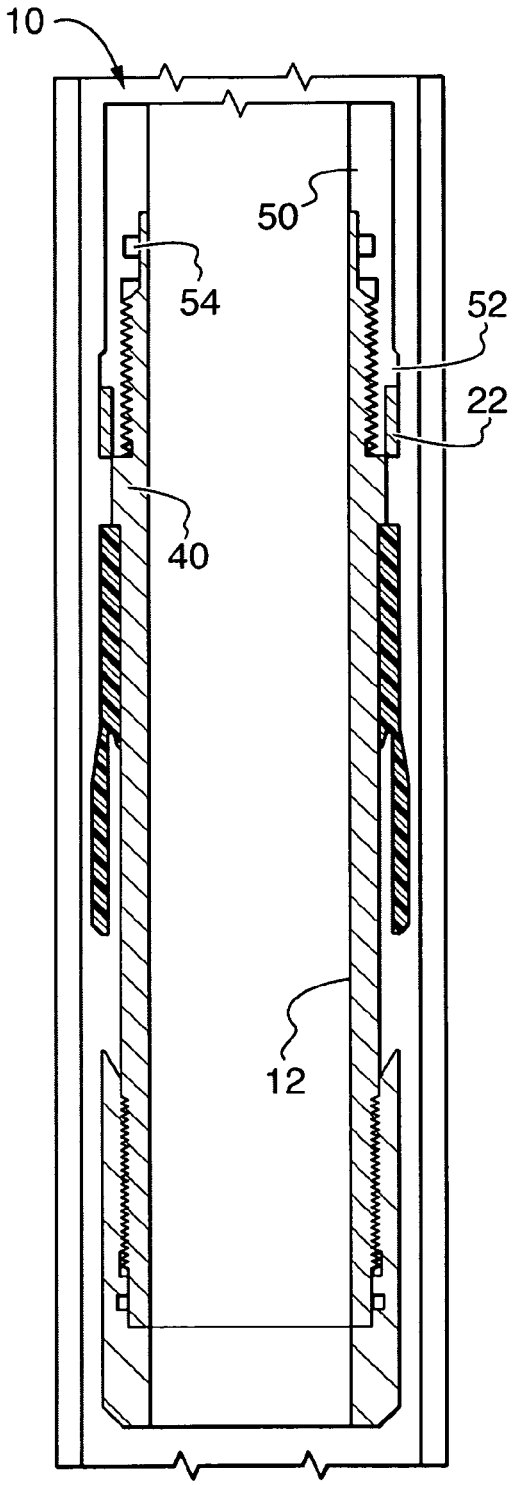
FIG. 5 is a cross-sectional view of a cup tool for a high-pressure mandrel in accordance with another embodiment of the invention wherein the gauge ring is slipped onto a bottom end of the high-pressure mandrel.
Figure 6:
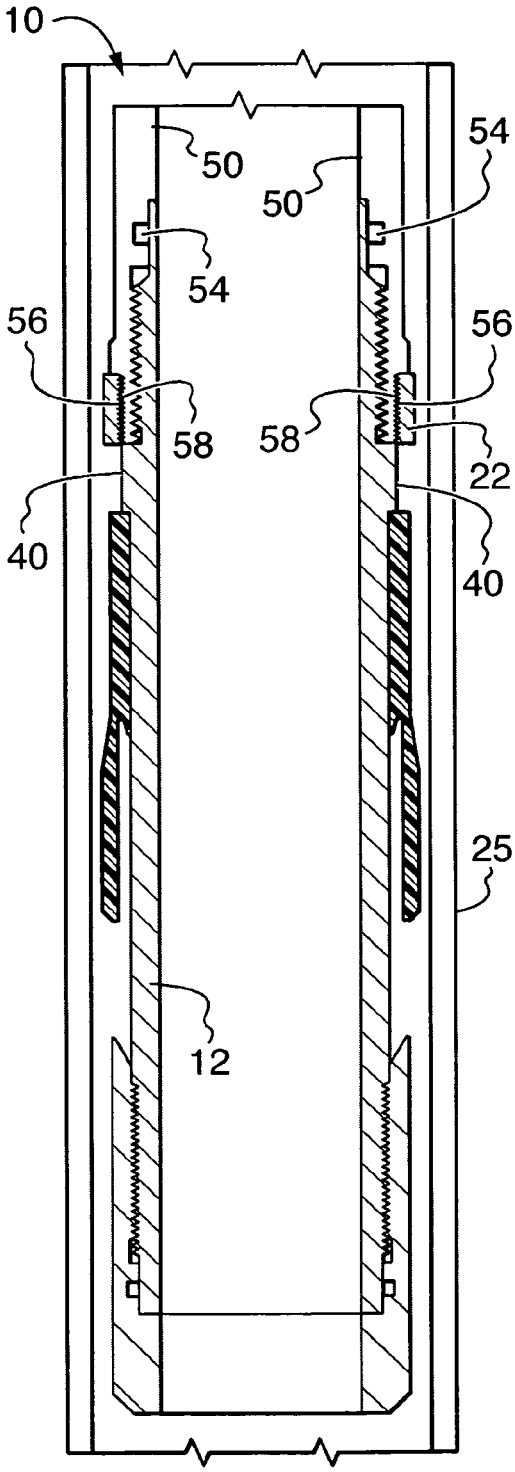
FIG. 6 is a cross-sectional view of a cup tool for a high-pressure mandrel in accordance with another embodiment of the invention wherein the gauge ring is threaded onto a bottom end of the high-pressure mandrel.

As illustrated in FIGS. 4–6, the cup tool 10 connects to the high-pressure mandrel 50 to form a lower end of a wellhead isolation tool, casing saver or blowout preventer protector for isolating pressure-sensitive wellhead components from the deleterious effects of high-pressure fracturing and stimulation fluids.

In the embodiment shown in FIG. 4, the cup tool 10 does not have a separate gauge ring. Rather, the gauge ring 22 is integrally formed at a bottom end 52 of the high-pressure mandrel 50. In one embodiment, the high-pressure mandrel is machined to present a right-angled annular shoulder to the top of the elastomeric cup. The high-pressure mandrel can also be machined to have an internal annular groove 54 that receives an annular sealing element such as an O-ring or ring gasket for providing a fluid-tight seal between the cup tool tube 12 and the high-pressure mandrel 50.

FIG. 5 illustrates a cup tool 10 in accordance with another embodiment of the invention. In this embodiment, the gauge ring 22 is slides in a frictional engagement over an annular recess in an outer surface of the high-pressure mandrel 50, at a bottom end 52 thereof. When the gauge ring is in position on the bottom of the high-pressure mandrel 50, the gauge ring 22 is flush with the bottom end 52 of the high-pressure mandrel 50 and abuts the top of the annular jump step 40, as shown in FIG. 5.

FIG. 6 illustrates a cup tool 10 in accordance with another embodiment of the invention which is similar to the embodiment shown in FIG. 5 except that the gauge ring 22 has box threads 56 for connecting to pin threads 58 on the bottom end 52 of the high-pressure mandrel 50.

Figure 7:
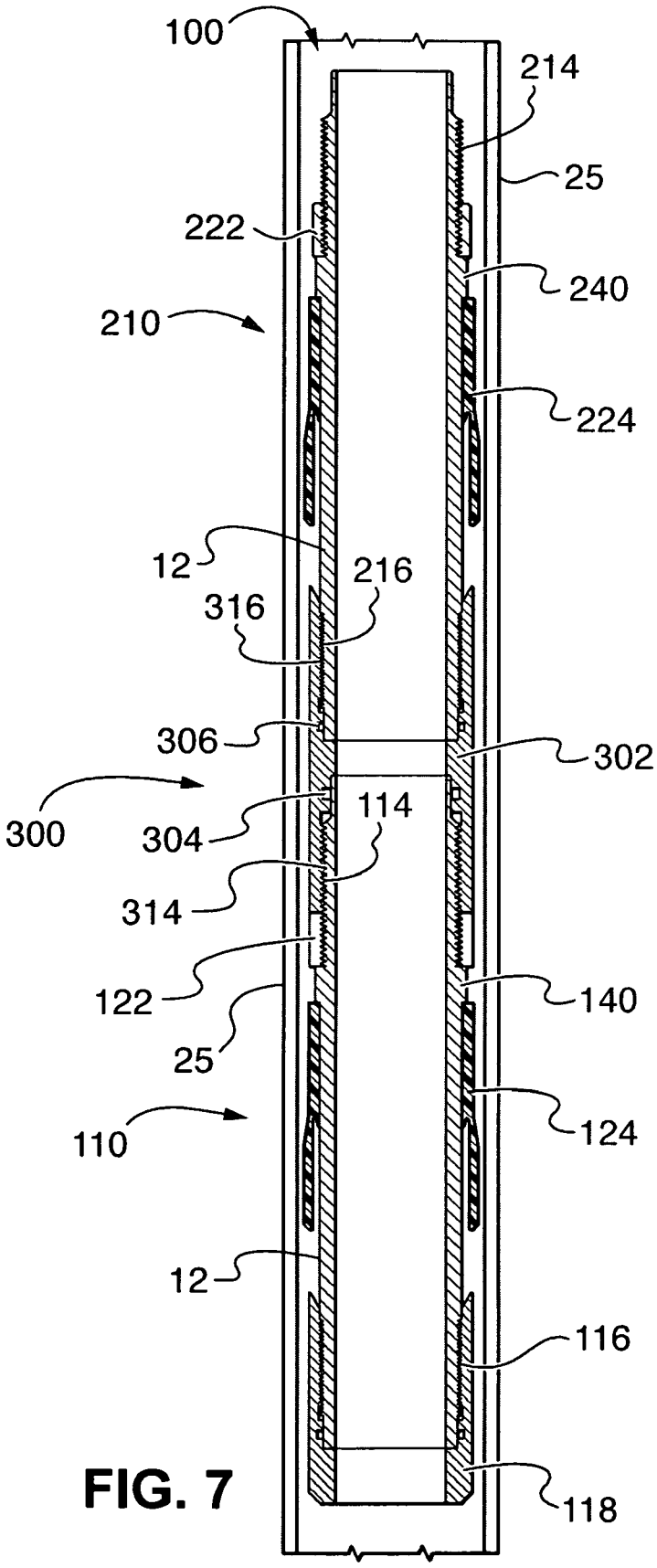
FIG. 7 is a cross-sectional view of a multiple cup tool assembled using a cup tool adapter in accordance with yet another embodiment of the invention.

For certain types of well stimulation operations, it is desirable to use a multiple cup tool, i.e. two or more cup tools in a serial configuration. At least two cups in series provides a safety factor when well stimulation is performed using cryogenic fluids, corrosive fluids such as acids, or the like. As illustrated in FIG. 7, a multiple cup tool 100 includes two cup tools (a first cup tool 110 and a second cup tool 210) that are connected together using a cup tool adapter 300. The upper pin threads 114 on the first cup tool 110 are connected to complementary box threads 314 on the cup tool adapter 300. The cup tool adapter 300 also has box threads 316 that are connected to the lower pin threads 216 on the second cup tool 210.

The first cup tool 110 typically has a bullnose 118 connected to the cup tool tube 12 by lower pin threads 116 for guiding the multiple cup tool 100 into the wellbore. The first cup tool 110 has an elastomeric cup 124 for providing the primary seal of the multiple cup tool. Under elevated fluid pressure, the elastomeric cup 124 of the first cup tool jumps over the annular jump step 140 and abuts an underside of a gauge ring 122 threaded to the upper threads 114 and locked in place by a bottom end of the cup tool adapter 300. The elastomeric cup extrudes into an annular gap to form the primary (high-pressure) seal.

The second cup tool 210 is connected by pin threads 214 to a high-pressure mandrel (not shown). The second cup tool 210 also has an elastomeric cup 224 for providing a secondary or backup seal to prevent fluid leakage if the primary seal (provided by the lower cup tool) were to fail.

As further shown in FIG. 7, the cup tool adapter 300 is a tubular sleeve 302 including a lower annular groove 304 located above the box threads 314 for receiving an annular sealing element, such as an O-ring or a ring gasket, for providing a fluid-tight seal between the cup tool adapter 300 and the cup tool tube 12 of the first cup tool 110. The tubular body 302 of the cup tool adapter 300 also includes an upper annular groove 306 located below the pin threads 316 for receiving an annular sealing element, such as an O-ring or a ring gasket, for providing a fluid-tight seal between the cup tool adapter 300 and the cup tool tube 12 of the second cup tool 210. As will be understood by those skilled in the art, any number of cup tools can be connected in series using the cup tool adapter 300.

The invention therefore provides a cup tool having an annular jump step that inhibits premature setting of the elastomeric cup during insertion of the cup tool into the wellbore. When the elastomeric cup jumps over the jump step and extrudes into the annular gap between the casing or tubing and the gauge ring, the resulting elastomer-to-metal seal is reliable at very high fluid pressures. In addition, because the gauge ring is behind the annular jump step 40 or incorporated into a bottom end 52 (FIGS. 4–6) of the high pressure mandrel, a sidewall of the cup tool tube 12 is thicker and the cup tool tube is therefore more pressure resistant. This permits higher pressures to be used during well stimulation operations.

It should also be noted that although the gauge rings 22, 122 and 222 shown in FIGS. 2–7 have flat bottom faces and square shoulders that are oriented towards the top end of the elastomeric cup 24, 124, 224. The gauge rings may have an angled, stepped, or beveled bottom face, each of which is known in the art.

It should be further be noted that although the invention has been described above with reference to unitary elastomeric cups, the inventive cup tool can be configured to accept any known and proven cup design, including cups that are bonded to one or more steel rings.

Modifications and improvements to the above-described embodiments of the present invention may become apparent to those skilled in the art. The foregoing description is intended to be exemplary rather than limiting. The scope of the invention is therefore intended to be limited solely by the scope of the appended claims.

We claim:

1. A cup tool for providing a high-pressure fluid-tight seal with a tubing or a casing in a wellbore, the cup tool comprising:

a cup tool tube having a threaded upper end for connection to a high-pressure mandrel, the cup tool tube having an outer surface over which an elastomeric cup is slidably mounted for movement from an unset position for entry of the cup tool into the tubing or casing to a set position in which an annular gap between the cup tool and the tubing or casing is obstructed by a top end of the elastomeric cup to contain fluid pressure below a bottom of the elastomeric cup, the cup tool tube including an annular jump step located below the threaded upper end, the annular jump step having a flat lower face and an outer diameter large enough to inhibit movement of the elastomeric cup to the set position during insertion of the cup tool into the tubing or casing; and a gauge ring located between the annular jump step and the high pressure mandrel, the gauge ring having a larger diameter than the annular jump step to form the annular gap between the cup tool and the tubing or casing.

2. The cup tool as claimed in claim 1 wherein the outer diameter, $OD_{STEP}$, of the annular jump step is expressed by the formula:

$$OD_{STEP}=ID_{TUBING}-2t+IFT,$$

where:

$ID_{TUBING}$ represents an inner diameter of the tubing or the casing;

t represents a wall thickness of an upper portion of the elastomeric cup; and

IFT represents an interference fit tolerance for providing a high-pressure fluid-tight seal between the elastomeric cup and the tubing or the casing.

3. The cup tool as claimed in claim 2 wherein IFT is about 0.100" to about 0.140".

4. The cup tool as claimed in claim 3 wherein IFT is about 0.120".

5. The cup tool as claimed in claim 1 wherein the diameter of the annular jump step is approximately equal to:

$$(OD_{CUP}+ID_{CUP})/2,$$

where:

$OD_{CUP}$ represents an outer diameter of an upper wall of the elastomeric cup before the elastomeric cup is in the set position; and $ID_{CUP}$ represents an inner diameter of the upper wall of the elastomeric cup before the elastomeric cup is in the set position.

6. The cup tool as claimed in claim 1 wherein the gauge ring has a flat bottom face.

7. The cup tool as claimed in claim 1 wherein the gauge ring slides in a friction fit on the cup tool tube and is secured against a top of the annular jump step by the high-pressure mandrel.

8. The cup tool as claimed in claim 1 wherein the gauge ring is threaded onto the cup tool tube and is locked against a top of the annular jump step by the high-pressure mandrel.

9. The cup tool as claimed in claim 1 wherein the gauge ring is integrally formed with a bottom of the high-pressure mandrel.

10. The cup tool as claimed in claim 1 wherein the gauge ring slides in a friction fit onto an outer annular recess formed on an outer surface of the high-pressure mandrel.

11. The cup tool as claimed in claim 1 wherein the gauge ring is threaded onto a pin threaded bottom end of the high-pressure mandrel.

12. A cup tool for providing a high-pressure fluid-tight seal below a high-pressure mandrel inserted into a tubing or a casing in a wellbore, the cup tool comprising:

a cup tool tube having a threaded upper end for connection to the high-pressure mandrel, the cup tool tube having an outer surface over which an elastomeric cup is slidably mounted for movement from an unset position for entry of the cup tool into the tubing or casing to a set position in which the elastomeric cup provides the fluid-tight seal with the tubing or the casing, the cup tool tube including an annular jump step having a flat bottom face and an outer diameter large enough to inhibit movement of the cup to the set position during insertion of the cup tool into the tubing or the casing; and a gauge ring located above the annular jump step, the gauge ring having a larger diameter than the annular jump step.

13. The cup tool as claimed in claim 12 further comprising a cup tool adapter for assembling a multiple cup tool comprising at least two identical cup tool tubes connected in series.

14. The cup tool as claimed in claim 13 wherein a first of the at least two cup tool tubes has a bullnose connected to a bottom end thereof for guiding the multiple cup tool as it is inserted through the wellbore.

15. The cup tool as claimed in claim 13 wherein the cup tool adapter comprises a tubular sleeve having first an second box threaded ends, the first and second box threaded ends further comprising an annular groove located inwardly of box threads on the respective box threaded ends, the annular grooves respectively receiving a seal ring for providing a high-pressure fluid seal between the respective cup tool tubes and the cup tool adapter.

16. A method of stimulating a well by injecting high pressure fluid through one of a casing and a tubing string suspended in a wellbore of the well, the method comprising:

installing a cup tool on a bottom end of a high-pressure mandrel, the cup tool comprising a cup tool tube having an outer surface over which an elastomeric cup is slidably mounted for movement from an unset position for entry of the cup tool into the one of the casing and the tubing string to a set position in which the elastomeric cup contains fluid pressure below the elastomeric cup, the cup tool tube including an annular jump step, the annular jump step having an outer diameter large enough to inhibit movement of the elastomeric cup to the set position during insertion of the cup tool into the one of the casing and the tubing string, and a gauge ring located between the annular jump step and the high pressure mandrel, the gauge ring having a diameter larger than the annular jump step;

injecting high pressure fluid through the high pressure mandrel and into the wellbore to move the elastomeric cup to the set position in which the elastomeric cup jumps over the annular jump step and extrudes upwardly into an annular gap between the gauge ring and the one of the casing and the tubing string to provide a high-pressure fluid-tight seal to protect wellhead components from the high pressure fluid injected to stimulate the well.

17. The method as claimed in claim 16 further comprising determining a weight of the one of the casing and the tubing string and selecting a gauge ring based on the weight of the one of the casing and the tubing string.

18. The method as claimed in claim 17 wherein selecting the gauge ring comprises selecting a gauge ring having a flat face and a square corner around which the elastomeric cup extrudes.

19. The method as claimed in claim 16 further comprising prior to connecting the cup tool to the high pressure mandrel, assembling a multiple cup tool comprising at least first and second cup tool tubes and first and second elastomeric cups, and connecting the multiple cup tool to the high pressure mandrel.

20. The method as claimed in claim 19 wherein assembling the multiple cup tool comprises connecting together a first cup tool tube and a second cup tool tube using a cup tool connector comprising a tubular sleeve having opposed box-threaded ends.

* * * * *

UNITED STATES PATENT AND TRADEMARK OFFICE

CERTIFICATE OF CORRECTION

PATENT NO. : 7,243,733 B2 
APPLICATION NO. : 11/182873
DATED : July 17, 2007
INVENTOR(S) : Bob McGuire and Danny L. Artherholt It is certified that error appears in the above-identified patent and that said Letters Patent is hereby corrected as shown below:

In column 5, please delete the paragraph beginning with "For certain operations, . . ." on line 8 through line 17, and replace the paragraph with -- $ID_{CUP}$ represents the inner diameter of the upper end of the cup 24 in the unset condition. In other words, the annular jump step 40 extends radially to approximately the middle of the top end the cup 24. --

Signed and Sealed this

Twenty-fourth Day of June, 2008

JON W. DUDAS
*Director of the United States Patent and Trademark Office*